United States Patent [19]

Axelsson et al.

[11] Patent Number: 4,856,709

[45] Date of Patent: Aug. 15, 1989

[54] FOLDING BOX

[75] Inventors: Owe Axelsson, Lund; Harry Holmgren, Loddekopinge, both of Sweden; Heinz Birkenbeul, Neider-Olm, Fed. Rep. of Germany

[73] Assignee: AB Akerlund & Rausing, Sweden

[21] Appl. No.: 116,447

[22] Filed: Nov. 3, 1987

[30] Foreign Application Priority Data

Nov. 6, 1986 [SE] Sweden ..... 8604759
Nov. 20, 1986 [SE] Sweden ..... 8604959

[51] Int. Cl.[4] ..... B65D 5/06; B65D 5/56

[52] U.S. Cl. ..... 229/125.34; 206/630; 229/48 T; 229/DIG. 5; 229/DIG. 9

[58] Field of Search ..... 229/125.34, 48 T, 48 SA, 229/48 SB, 48 R, DIG. 5, DIG. 9, 4.5, 49; 206/606, 611, 620, 630

[56] References Cited

U.S. PATENT DOCUMENTS

| | | | |
|---|---|---|---|
| 981,993 | 1/1911 | Gair et al. | 229/48 R |
| 1,511,915 | 10/1924 | Sherk | 229/4.5 |
| 1,845,456 | 2/1932 | Wagner | 229/DIG. 5 |
| 1,987,545 | 1/1935 | Alexander | 229/48 SB |
| 1,993,205 | 3/1935 | Bowersock et al. | 229/48 R |
| 2,027,747 | 1/1936 | Morton | 229/48 R |
| 2,536,990 | 1/1951 | Williamson | 229/DIG. 5 |
| 2,745,591 | 5/1956 | Holt, Jr. | 229/49 |
| 2,962,202 | 11/1960 | Hansen | 229/37 R |
| 3,021,994 | 2/1962 | Wolfe | 229/48 R |
| 3,137,217 | 6/1964 | Elliott | 229/DIG. 5 |
| 3,147,902 | 9/1964 | Miller | 229/4.5 |
| 3,332,602 | 7/1967 | Flax | 229/DIG. 9 |
| 3,692,226 | 9/1972 | Young et al. | 229/125.42 |
| 3,826,421 | 7/1974 | Morse et al. | 206/630 |

FOREIGN PATENT DOCUMENTS

| | | | |
|---|---|---|---|
| 820135 | 8/1969 | Canada | 206/630 |
| 3330735 | 7/1985 | Fed. Rep. of Germany . | |
| 376 | of 1880 | United Kingdom | 229/48 R |

*Primary Examiner*—Gary Elkins
*Attorney, Agent, or Firm*—Lerner, David, Littenberg, Krumholz & Mentlik

[57] ABSTRACT

A folding box of cardboard or similar material, comprising a casing having a longitudinal joint and top and bottom end closures and preferably sealing membranes attached to flaps of said end closures.

The longitudinal joint of the folding box is formed as an abutting edge joint which at least partially along a substantial length of the total folding box length has an extension which is not parallel to the side edges of the folding box. Especially in the case where sealing membranes exist, the joint extends the whole way out to the free cut edges of each end flap of the top and bottom end closure, respectively, and the cross section of the folding box is covered by a sealing membrane attached against flaps at each end of the folding box.

The longitudinal joint is covered by a strip, placed extrenally or internally or on both sides of the wall. The strip is of a thin material, preferably of a thickness around 20–50 μm and covers the joint at both sides thereof.

Preferably, the strip has a grip portion which, when gripped results in tearing up of the folding box side along perforations placed outside or inside, preferably inside, the longitudinal edges of the strip.

11 Claims, 4 Drawing Sheets

FIG. 2
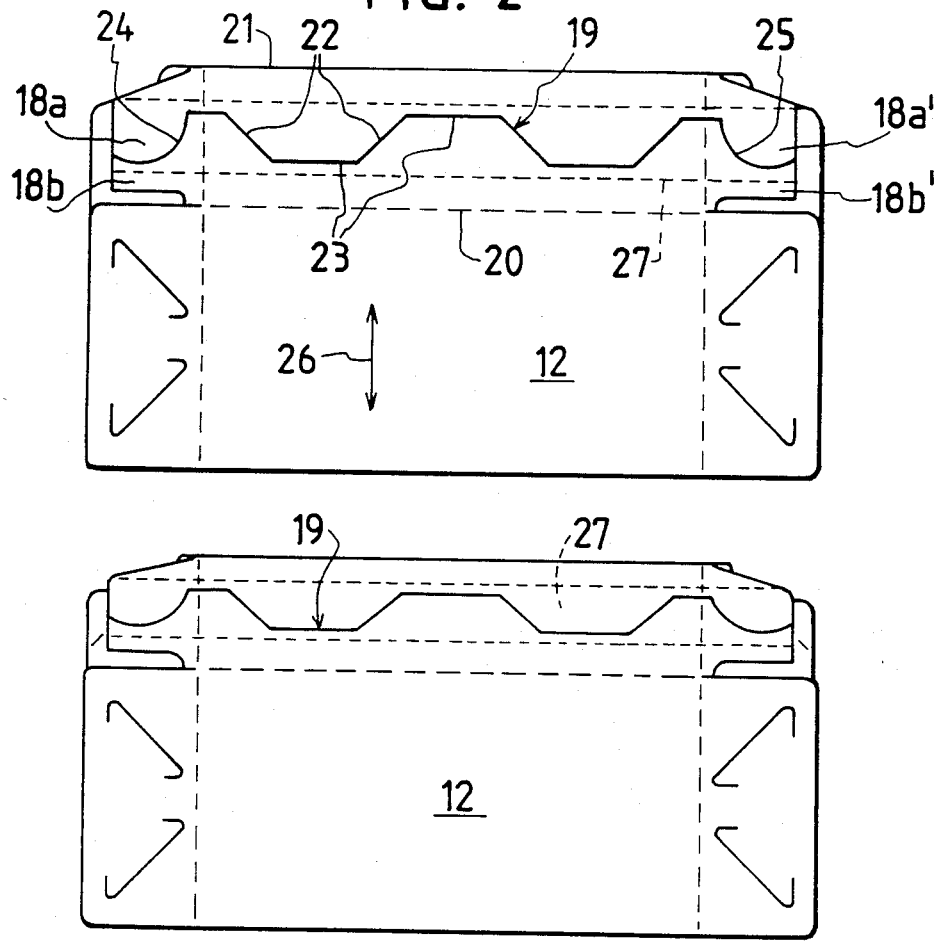
FIG. 3
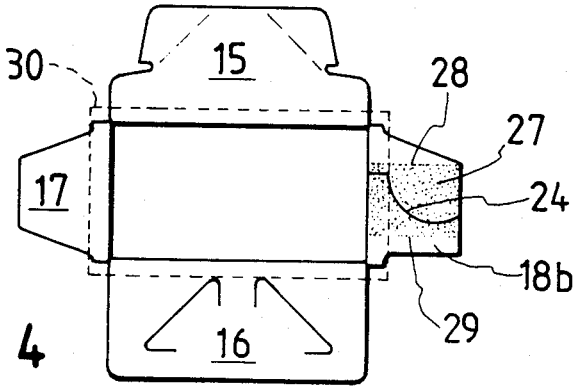
FIG. 4

FOLDING BOX

FIELD OF THE INVENTION

The present invention relates to a package of the folding box type or a similar package manufactured from cardboard or an equivalent material. More precisely the invention relates to a strong, in a preferred embodiment easy openable, folding box structure or sleeve structure of a material saving type having a longitudinal joint, and when applicable said folding box may be closed by a sealing membrane or membranes covering one or both end openings of the folding box.

BACKGROUND OF THE INVENTION

Traditionally, folding boxes, i.e. sleeve shaped bodies having end flaps, are glued or assembled such that they get a longitudinal joint which according to the established folding box technique has an overlap. Theoretically, however, the prior art does also disclose a folding box having a non-overlapping joint as shown in U.S. Pat. No. 981 993 from 1911.

Within another field of the packaging technique, i.e. the technique where sleeves are used, i.e. folding box structures without end flaps, an assembling technique using abutting edge joints is previously known for sleeve blanks. Such packaging sleeves are closed by separate end closures, for instance of metal or plastics.

Thus, abutting edge technique has previously been used when manufacturing folding boxes and sleeves, but as far as applicants know, such technique has not been transferred to the field of modern or present day folding boxes technology. Instead, within such technical field, there has been used an overlap joint of the shearing force joint type, overlap flap joint or any similar arrangement.

SUMMARY OF THE INVENTION

According to a first aspect of the present invention it has been realized that a considerable saving of material may be obtained when manufacturing modern type folding boxes provided the said overlapping joint may be eliminated.

According to another, or when applicable, supplementing aspect of the present invention the abutting edge joint technique is used for providing planar sealing surfaces for sealing membranes at the ends of the box. Arrangements are made for the abutting edge joint to extend the whole way out to the free cut edges of a pair of flaps at each folding box end.

Starting from the first mentioned aspect and the fact that the fibre direction of the folding box blank traditionally is oriented in the crosswise direction of the folding box walls, according to the present invention, it has been realized that a conventional shearing force type of joint, for instance of the overlapping joint type is not necessary for obtaining an acceptable strength of the longitudinal folding box joint.

According to the present invention it is suggested a folding box of cardboard or similar material comprising a casing having a longitudinal joint and top and bottom closures. The folding box is characterized in that the longitudinal joint is an abutting edge joint, which at least along a substantial length of the total folding box length has an extension which is not parallel to the side edges of the folding box.

In a preferred embodiment, the joint is covered by a strip attached to the folding box, for instance heat sealed to the box.

Preferably, the said joint has several discontinuities and for instance it is arranged as several truncated trapezoid extensions gripping into each other. As an alternative to rectilinear sub-sections, for instance the said trapezoids, it is possible to use a not rectilinear geometry, for instance a wave shaped or sinus type joint line.

In that case where the inventive object also includes the said further or supplementing aspect relating to the membrane end closure or closures, arrangements are made for making the joint extend out into the end flaps the whole way up to the cut edges of said flaps, and a membrane of a flexible material is attached to the flaps and arranged for covering the folding box cross section.

In a further embodiment the present invention offers as an alternative an easy opening folding box structure which is closed by a closure or sealing membrane at least at one end thereof.

According to the present invention such a membrane can be sealed against a generally planar surface obtained by folding out of the end flaps, the surface being generally planar because the longitudinal joint is a joint of the abutting edge joint type, which is assembled by a thin strip that covers the entire joint along the extension thereof without noticeably increasing the thickness of the material of the folding box.

Thus, according to the further or supplementing aspect of the present invention there is provided a folding box of cardboard or similar material comprising a casing formed by side walls and end flaps connected to the side walls. The folding box is characterized in that it has a longitudinal abutting edge joint, which extends out into the adjoining end flaps the whole way out to the free cut edges of said flaps, that a thin strip is arranged for covering the joint, and that a closure membrane is attached to the end flaps at at least one end of the folding box and arranged for covering the folding box cross section.

In said further embodiment of the folding box, the box has an easy opening arrangement and is characterized by a longitudinal weakening of the cardboard material arranged at the side of the box having a strip or strips (external or internal), in that the strip has an extended portion acting as a grip portion, and that the weakening is such that it will be broken through when the gripping portion is pulled, in the direction of the longitudinal weakening.

In a specific embodiment the weakening is arranged as a perforation or corresponding outside or inside, preferably inside, the longitudinal edges of the strip, along the entire length of the folding box and the end flaps thereof.

Basically, the strip arrangement may be such that the strip is arranged at the inside and/or outside of the folding box.

In one embodiment the abutting edge joint is arranged generally parallel to the long side edges of the folding box.

In another embodiment the abutting edge joint is arranged generally in a diagonal direction in the folding box side and the adjoining end flaps.

BRIEF DESCRIPTION OF THE DRAWINGS

FIG. 2 shows the folding box as assembled and flattened, FIG. 3 shows the folding box somewhat expanded, FIG. 4 shows the box seen from either one of the ends and with folded out flaps, FIG. 5 in a planar view shows a second embodiment of a folding box blank for a folding box according to the present invention, FIG. 8 shows a third embodiment of a folding box blank for a folding box according to the present invention, and FIG. 9 shows a fourth embodiment of a folding box blank for a folding box according to the present invention.

DESCRIPTION OF PREFERRED EMBODIMENTS

Figure 1:
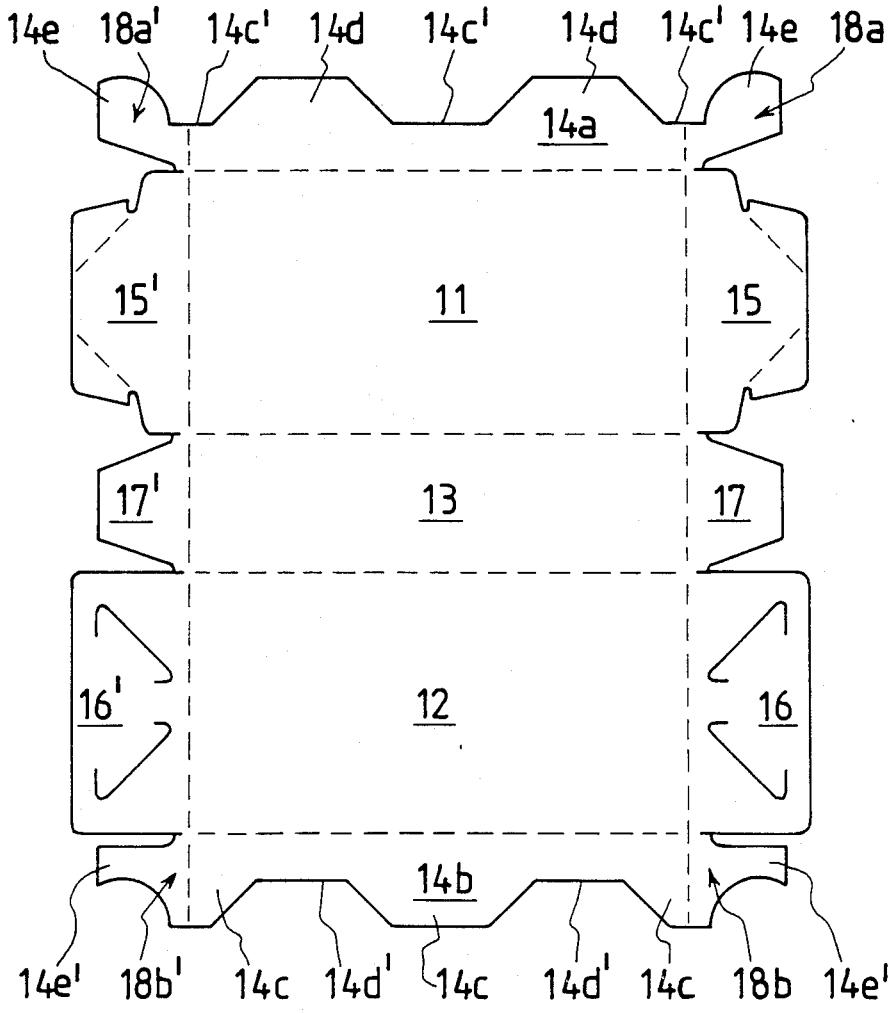
FIG. 1 in a planar view shows a blank of a folding box according to the present invention.

The folding box blank in FIG. 1 comprises broad side wall panels 11, 12 and a panel 13 forming a complete narrow side wall and panels 14*a*, 14*b* which together are intended to form the second narrow side wall.

End flaps 15–17, 18*a*, 18*b* and 15′–17′, 18*a′*, 18*b′*, respectively, are arranged for forming end closures of the folding box. The blank consists of traditional type of cardboard material or similar.

Each partial flap or sub-flap 14*a*, 14*b* has a truncated trapezoid extension 14*c* and 14*d*, respectively. Said extensions are complementary shaped relative the cut outs 14*c′* and 14*d′*, respectively, in a corresponding second sub-flap. The end sub-flaps 18*a*, 18*a′* have rounded extensions 14*e*, the shape of each of which is complementary to cut outs 14*e′* in the end flaps 18*b*, 18*b′*.

Abutting edge assembling of the sub-panels 14*a* and 14*b* gives the discontinuous joint line 19 in FIG. 2 having straight subsections 22 which are not parallel to the folding box side edges 20, 21, and subsections 23 parallel to the folding box edges 20, 21 in the narrow side wall forming the assembling side. Instead of straight sub-sections, it is also possible to have curved sections 31, as indicated in FIG. 8, or another type of not rectilinear geometry. In the abutting edge joint assembled sub-section end flaps 18*a*, 18*b* and 18*a′*, 18*b′* there are domed joint sub-sections 24, 25.

The fibre direction of the cardboard material is indicated by the double arrow 26. The strength of the folding box crosswise the extension of the line 19 is therefore determined by the fibre breaking strength. In the longitudinal direction of the folding box the grip between the extensions and the cut outs along the line 19 provides a locking effect and a shearing type of joint in the longitudinal direction. In order to guarantee that this shearing joint will not break up because the locking engagement between the extensions and the cut outs is lost due to handling, such elements are anchored by means of a thin strip 27 placed internally and attached to the sub-flaps and the sub-panels such that it covers the entire length of the joint line 19. If required there may also be a strip at the outside of the folding box or just at the outside and not at the inside.

As the material of the actual folding box usually is a cardboard material coated by a thermoplastic material, generally polyethylene, the strip may be a thin, say 20–50 μm thick thermoplastic film strip which is sealed against the plastic coated cardboard material. It is also possible to attach a strip also against a non-plastic coated cardboard and of course also against other material than cardboard.

Such a strip thickness provides a very safe assembling of the discontinuous joint, and at the same time the assembling technique gives just an unnoticeable thickening or discontinuity 28, 29 in the plane of the end flaps 18*a*, 18*b* and 18*a′*, 18*b′*, respectively.

This discontinuity is so uncritical that a sealing membrane 30, for instance of a thermoplastic coated paper, is attachable to the folded out end flaps in FIG. 4 without giving penetration susceptible channels along the edges of the strip, which is the one and only area where thickness variations exist on the flap consisting of the strip and the sub-flaps, as the abutting edge joint 19 does not give any addition of material thickness.

Figure 5:
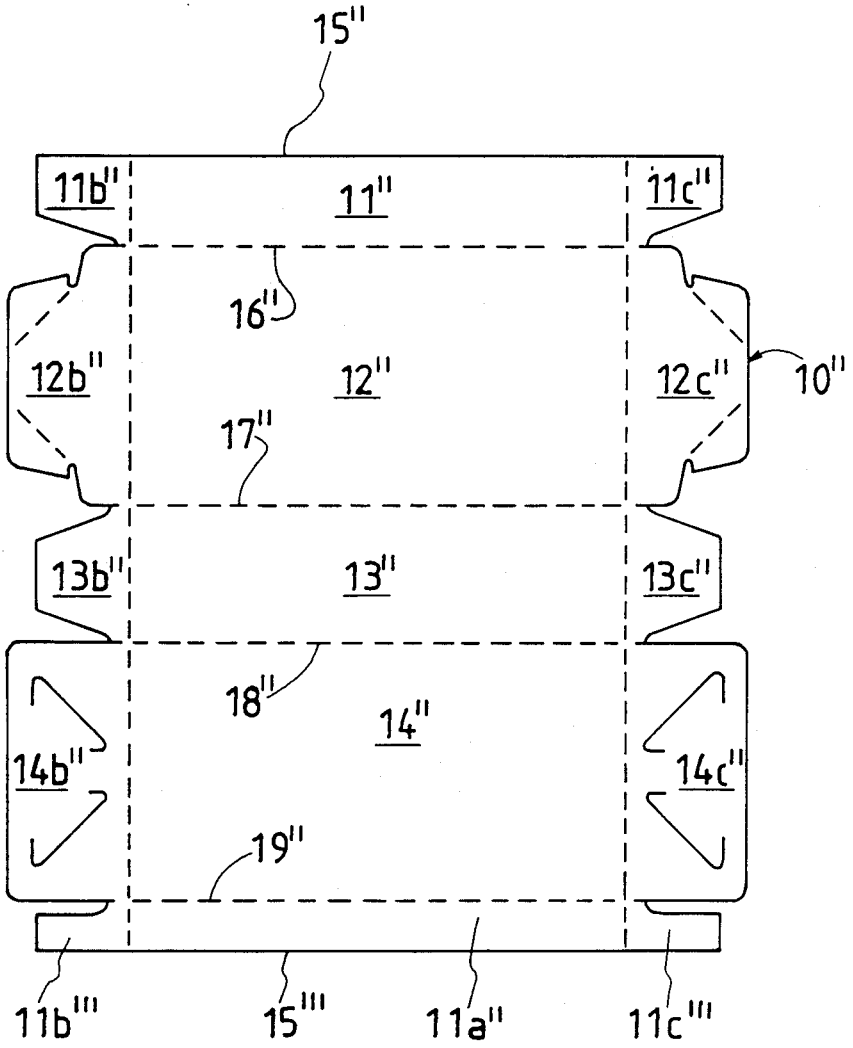

The folding box blank 10″ in FIG. 5 comprises, in the traditional manner, sub panels 11″, 12″, 13″, 14″ and 11*a″* forming the casing part or "sleeve" of the folding box. In the traditional way such sub panels have end flaps 11*b″*, 11*c″*, 12*b″*, 12*c″*, 13*b″*, 13*c″*, 14*b″*, 14*c″* and 11*b″*, 11*c″*.

In the embodiment shown by solid lines in FIG. 5 the cut edges 15″, 15‴ are parallel to the creasing lines 16″, 17″, 18″, 19″ formed for defining the longitudinal side edges of the folding box. The lines 20″, 20‴ in FIG. 9 illustrate another embodiment where the cut edges form a joint (abutting edge joint) extending generally in a diagonal direction in the sub flap 11*a″* when the folding box is erected.

Figure 6:
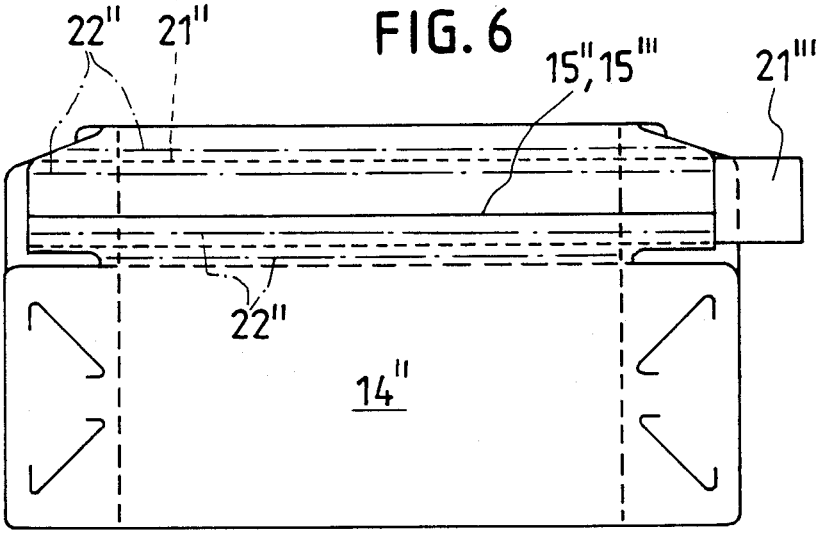
FIG. 6 shows the folding box blank or blanks in FIG. 5 in an intermediate stage where a sleeve is formed and where in the embodiment shown, the strip securing the joint is extended by a grip portion.
Figure 7:
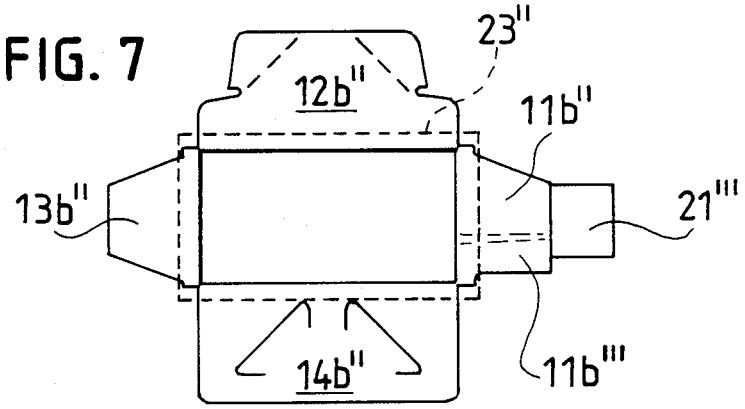
FIG. 7 shows the folding box blank in FIG. 6 erected and end closed or sealed by a membrane.

In FIG. 6 the folding box blank in FIG. 5 is arranged as an intermediate product. The joint 15″, 15‴ (the solid line version) extends parallel to the long side wall edges of the folding box and on both sides of the joint there is a strip 21″ securing the joint and forming a grip portion by an extended portion 21‴ acting as an easy opening arrangement. Of course, such an arrangement is possible for any embodiment of the present invention.

The strip is of a thin material, within the range from 20–50 μm, and for instance, it may be a polyethylene strip, which is to be heat sealed against the thermoplastic coated side of the folding box. As "side" the inside of the folding box may be used, which is shown in FIG. 2, but it is here also possible to arrange the strip at the outside or even on both sides of the folding box.

Thus, the strip is thin and thereby it does not noticeably increase the thickness of the material in the assembled folding box wall 11″, 11*a″*, neither at the flaps 11*b″*, 11*b‴* nor at the flaps 11*c″*, 11*c‴*. As the extension direction of the joint 15″, 15‴ is a direction generally perpendicular to the fibre orientation of the cardboard material of the folding box, the general object of the strip 21″ or strips 21″ is to provide a shearing force resisting joint in the plane of the side 11″, 11*a″*. In certain applications such a joint may be obtained by one single strip at one side of the folding box, in other applications it may be suitable to have double strips or alternatively an external strip.

In the embodiment where the joint has a "diagonal" extension 20″, 20‴ it may for instance be sufficient to have a single strip, while in the embodiment having a parallel extension 15″, 15‴, it may be necessary to have double strips.

In both cases or preferably in all three embodiments, arrangements are made for providing a grip portion 21‴ for opening the folding box or breaking up of the folding box side 11, 11*a*. In order to facilitate this breaking up operation there is a longitudinal weakening 22″ (shown by phantom lines) arranged just outside or inside (both alternatives have been shown) the two outer longitudinal edges of the strip. Said weakening denotations form breaking through denotations in the folding box wall as soon as the strip is gripped by the grip portion 21‴ and a force is applied along the joint 15″, 15‴ or 20″, 20‴.

Such a tearing up is of course especially desirable in that case where the folding box has end closures, at one or both ends, obtained by a sealing or closure membrane 23, for instance of a thin paper coated by plastics, aluminum foil or similar.

The folding box cross section is efficiently sealed by a membrane which is attached, for instance heat sealed, against horizontally folded out end flaps 12*b*″, 13*b*″, 14*b*″, 11*b*″. In that case where the strip 21″ is placed internally in the folding box, this just means a very insignificant thickening of the material of the edge abutting joint formed in the end flap 11*b*″, 11*b*‴, meaning that the sealing of the membrane 23 is carried out against a generally plane surface.

Although a few embodiments have been described and illustrated it is realized that modifications and alternatives are possible within the scope of the accompanying claims.

We claim:

1. A folding box of cardboard or similar material having at least an inner surface of a heat sealable material, said box comprising, a casing having side walls to define an exterior and an interior and a longitudinal axis, longitudinally extending end flaps integrally connected to said side walls, said end flaps forming first and second closures on said casing, each said end flap having an interior surface and an exterior surface, a longitudinal joint on one side wall, said longitudinal joint extending from said side wall through at least one end flap, said longitudinal joint being an abutting edge joint having along a substantial length thereof at least one portion which is not parallel to said longitudinal axis of said casing, a thin strip heat sealed to the interior of said casing to cover said longitudinal joint thereby adding strength to said abutting edge joint, said thin strip providing only a minimal discontinuity on the interior surface of said end flap, and a sealing membrane of a flexible material attached to said interior surface of said end flaps on the first closure of said casing to provide a hermetic seal beneath said closure formed by said membrane sealed end flaps even in the area of said thin strip on the interior surface of the end flap with the longitudinal joint.

2. The folding box in claim 1, wherein said abutting edge joint comprises a discontinuous joint so constructed and arranged to provide a shearing joint.

3. The folding box in claim 1, wherein said abutting edge joint comprises straight portions which are not parallel to the longitudinal axis of said casing and straight portions which are parallel to the longitudinal axis of said casing.

4. The folding box in claim 3, wherein said abutting edge joint is formed by truncated trapezoidal extensions and complementary cutouts.

5. The folding box in claim 1, wherein said abutting edge joint comprises portions which are of a non-rectilinear geometry.

6. The folding box in claim 1, including a longitudinal weakening of the cardboard material and a grip portion extending from said thin strip such that said weakenings are broken when said grip portion is pulled in the longitudinal direction of said weakening.

7. The folding box in claim 6, wherein said longitudinal weakening is a perforation located in the portion of the casing on which said thin strip is heat sealed.

8. The folding box in claim 7, including a second thin strip arranged on the outside of said folding box.

9. The folding box in claim 1, wherein said abutting edge joint is generally diagonal across said side wall having said longitudinal joint.

10. The folding box in claim 1, wherein said thin strip has a total thickness of about 20–25 μm and is made of plastic-coated paper.

11. The folding box in claim 1, wherein the casing includes fibre extending in the direction transverse to said longitudinal axis of said casing so as to provide additional strength.

* * * * *